US005249332A

United States Patent [19]

Wilkerson

[11] Patent Number: 5,249,332

[45] Date of Patent: Oct. 5, 1993

[54] PAVEMENT SWEEPER

[75] Inventor: Kenneth R. Wilkerson, Irvington, Ill.

[73] Assignee: Commercial Sweeper Systems, Inc., Irvington, Ill.

[21] Appl. No.: 785,480

[22] Filed: Oct. 31, 1991

[51] Int. Cl.[5] ..... E01F 1/04

[52] U.S. Cl. ..... 15/384; 15/83; 15/340.4; 15/348; 15/349

[58] Field of Search ..... 15/348, 349, 340.4, 15/84, 87, 83, 79.2

[56] References Cited

U.S. PATENT DOCUMENTS

| | | | |
|---|---|---|---|
| 1,514,949 | 11/1924 | Bell et al. | 15/384 X |
| 1,906,766 | 5/1933 | Ray | 15/84 |
| 2,708,280 | 5/1955 | Antos et al. | 15/83 |
| 2,739,340 | 3/1956 | Blydenburgh et al. | 15/384 X |
| 3,636,585 | 1/1972 | Larsen | 15/83 X |
| 3,942,218 | 3/1976 | Krier et al. | 15/340.4 |
| 4,393,537 | 7/1983 | Reprogle et al. | 15/348 |
| 4,624,026 | 11/1986 | Olson et al. | 15/340.4 |
| 4,741,072 | 5/1988 | Wilkerson . | |
| 4,930,530 | 6/1990 | Crego et al. | 15/348 X |

*Primary Examiner*—Chris K. Moore
*Attorney, Agent, or Firm*—Kalish & Gilster

[57] ABSTRACT

An apparatus for automated sweeping of debris from pavement surfaces is provided with a rigid housing, paired roller brooms rotatably mounted transversely within the housing parallel in relation to each other such that the right end of the forward roller broom, as from the position of an operator of the apparatus, rotates clockwise and the right end of the rearward roller broom, from the same viewpoint, operates counterclockwise. A debris outlet for exit of debris from inside the housing to the exterior thereof is provided along with an auger conveyor for focusing movement of debris between the housing and the rearward roller broom toward the debris outlet. A plurality of support wheels are rotatably attached to the housing and welded connections are provided for attaching the apparatus to a prime mover to permit propulsion of the apparatus along the surface to be swept, as well as for transport of the apparatus. Inside the housing are provided a deflection shield to deflect debris thrown upward by the forward roller broom toward the second roller broom, a reinforcing plate to protect the housing from contact by the brush bristles of the second roller broom and a berm builder to enhance movement of debris through the apparatus.

20 Claims, 4 Drawing Sheets

PAVEMENT SWEEPER

BACKGROUND AND SUMMARY OF THE INVENTION

1. Field of the Invention

This invention relates in general to pavement cleaning equipment, and more particularly to a compact, mobile unit suitable for propulsion by a detachably engaged automotive vehicle for use in cleaning pavement such as streets, parking lots and the like.

2. Description of the Prior Art

Conventional street sweeping apparatuses as, for example, commonly used by cities, consist of mobile truck-like vehicles integrally provided with disk-shaped rotatable brushes for movement of dirt and debris away from the curb toward the street into the path of the mobile unit for collection. Dust is ordinarily controlled with such devices by use of water which must often be transported on the street sweeping apparatus or some other vehicle. Of course only finite amounts of water can be so supplied, necessitating expenditure of time to stop and refill. Whether carried on the sweeper unit or independently supplied, as from fire hydrants, a great deal of water (which is in short supply in some geographical areas) is required.

Street sweepers of the water using variety are only suitable for use in above-freezing ambient temperatures as use otherwise would create icy, hazardous conditions and contribute to dangerous and expensive pavement breakdown caused by repeated freezing and thawing of water which remains in cracks and pores of the pavement surface. Use of such sweepers without water would necessarily create unacceptable clouds of dust during broom operation. Of course, such devices also are not suitable for use in certain industrial areas where water would create a risk of electrocution.

An earlier patent issued to Wilkerson, U.S. Pat. No. 4,741,072, describes a cleaner that is a non-self-motivated, compact, lightweight mobile unit adapted for travel along railroad tracks to be cleaned. The cleaner was further provided with front and back pairs of wheels adapted for attachment to railroad tracks and provided with laterally extending blades for scraping debris toward a single transversely mounted broom assembly having wide, curved finger-like broom members for lifting debris toward a transverse feed conveyor for vacuum-assisted movement of the debris toward a hopper. It was designed for use only on railroad tracks and was not designed for, nor capable of, use on pavement surfaces, as, for example, the wheels thereof would gouge ruts into the pavement and the cut outs provided to accommodate rails would be unnecessary for pavement cleaning.

In contrast to standard street sweeping methods a well-known procedure in railroad track cleaning is to manually develop a berm of cinders, slag, and the like on the tracks and adjoining rail area directly in front of the cleaning device to provide a "wall" against which to push debris with such device. This step facilitates collection of the blocked debris by the device, rather than the undesired consequence of pushing some of the debris away and free from the sweeper which occurs when a berm is lacking. Such loss of debris is inefficient as it requires later manual collection. The same result often occurs with ordinary street sweeping units which may knock some clutter away from the direct line of the collection/sweeping device, requiring a second pass, or manual clean up to complete the job. The new sweeper device, as described and claimed below contemplates inclusion therein of a construction which eliminates the need for such manual berm development.

Accordingly, it is among the objects of the present invention to provide an apparatus which is suitable for year-round sweeping of pavement surfaces whether of concrete, asphalt, rock, packed earth or otherwise, regardless of ambient temperatures, and that the apparatus be adapted internally, as with a "berm builder" disposed between paired roller brooms, for especially efficient movement of debris through the apparatus toward a debris containment device.

It is a still further object that the new sweeping apparatus be capable of use in combination with a vacuum and elevator arrangement such as, for example, that described in U.S Pat. No. 4,741,072, previously referred to herein to facilitate removal of debris and dust from the new device as it is operated, without the use of water, so as to reduce hazardous conditions, destruction of pavement and waste of natural resources.

It is further among the objects of the present invention to provide an apparatus having the described features which is non-self-motivational, as lacking locomotive means, but is adapted for attachment and movement by an automotive-type vehicle, both for transport and cleaning of a pavement surface.

It is another object of the present invention to provide such an apparatus, the brooms and brushes of which are capable of adjustment to compensate for wear which occurs through use thereof.

It is yet another object of the present invention having the described features which is further adapted with forwardly mounted circular rotational brushes which may be raised or lowered for selective use thereof and provided with some degree of horizontal "give" to prevent damage to a support arm as such brushes are used along a curb or gutter.

It is a still further object of the present invention to provide such an apparatus having the features stated which is also adapted with an inspection door for convenient observation of and access to at least a portion of the interior of the apparatus.

It is further among the objects of the present invention that the broom or brush portions thereof be capable of being powered by either hydraulic or pneumatic methods.

It is yet another object of the present invention that such apparatus be simple in design and operation so as to be economical to manufacture, maintain and operate by individuals with a minimal degree of training and only a few hand tools.

Other objects will be in part apparent and in part pointed out hereinbelow.

In furtherance of these objects, the present invention is, briefly, an apparatus for automated sweeping of debris from pavement surfaces. The apparatus includes a rigid housing and first and second roller brooms rotatably mounted transversely within the housing spacedly and parallel in relation to each other. The first roller broom is disposed forwardly of the second roller broom, each of the roller brooms being elongated and having right and left ends relative to a position of an operator of the apparatus and extending therebetween. The apparatus is adapted for causing the first roller broom to rotate clockwise, as viewed from the right end thereof, and for causing the second roller broom to rotate counterclockwise as viewed from the right end thereof. A debris outlet connected to a vacuum source for removal of debris from inside of the housing to the exterior thereof is provided, as well as a construction disposed within said housing substantially beneath said debris outlet for focusing movement of debris within the housing toward the debris outlet. A plurality of support wheels are rotatably attached to the housing, and the apparatus is adapted for connecting to a prime mover to thereby permit propulsion of the apparatus along the surface being swept and transport of the apparatus when non-operational.

The apparatus is further adapted for building up a berm of debris within the housing rearwardly of the first roller broom and substantially parallel thereto. The "berm builder" is disposed transversely within the housing and connected thereto between the first roller broom and the second roller broom.

The rigid housing consists of a top wall, a front wall, a rear wall, and left and right side walls forming an open-bottomed enclosure, an interior thereof having a forward portion and an upper rearward portion, and the left and right side walls being substantially parallel to each other. The rigid housing is provided on the interior thereof with a rigid debris deflection plate transversely fixed to the top wall of the housing forwardly and adjacent in relation to the second roller broom so as to be longitudinally substantially coextensive therewith and to angle downwardly toward the second roller broom and away from the top wall of the housing.

DESCRIPTION OF THE PREFERRED EMBODIMENT

Figure 1:
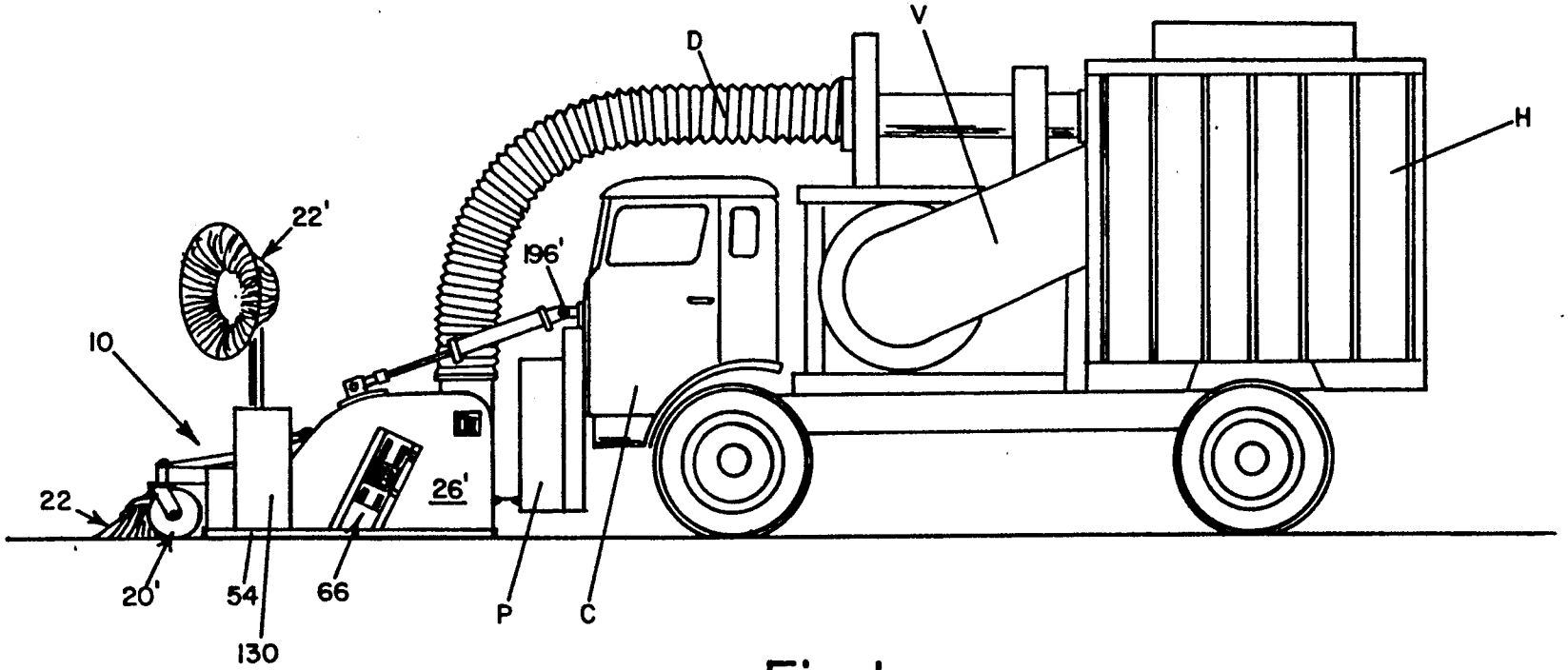
FIG. 1 is a left side elevation view of an automotive vehicle having attached thereto a pavement sweeper constructed in accordance with and embodying the present invention for operational purposes.

With reference to the drawings, in FIG. 1, 10 generally designates the new pavement and track sweeper connected as for operation, to a prime mover, for example, to a cab C of a truck T having a hopper H mounted thereon. Preferably, a debris conduit D permits passage of debris from sweeper 10 to hopper H as assisted by a vacuum source, V. A conventional hydraulic control unit P (shown schematically), mounted forwardly on cab C, provides power for operation of sweeper 10. Ideally, hopper H is provided internally with air filters to assist in capture and disposal of dust collected by apparatus 10. Such air filtration systems are known and readily commercially available.

FIGS. 2 through 5 illustrate the general positional relationship of roller brushes 12, 14 and auger 16 within housing 18, as well as support wheels 20, 20' and rotatable disk-shaped brush assemblies 22, 22' mounted externally forwardly on apparatus 10, all as discussed in further detail hereafter. It is to be understood that throughout this description the terms "left" and "right" are intended to refer to directions relative to the position of a driver (not shown) seated in cab C as for operation of truck T and sweeper apparatus 10.

Housing 18 is preferably constructed of hardened steel of at least one quarter inch thickness and consists of a substantially vertical back wall 24 weldably attached along opposing side edges thereof to substantially vertical right and left sidewalls 26, 26', respectively, which side walls 26, 26' are positioned parallel to each other and extend forwardly to intersect opposing side edges of a front wall 28 to which said side walls 26, 26' are securely fixed, for example, as by welding or bolting.

Housing 18 forms an open-bottomed enclosure, preferably about 85 inches wide and about 70 inches long, covered by a top wall 30, preferably having a substantially horizontal, flat, transverse forward portion 30*a* weldably connected at a front edge thereof to a top edge of front wall 28 and extends rearwardly to intersect and continue into an upwardly angled portion 30*b* which extends upwardly rearwardly to curve over rearward roller brush 14 and to thereafter flatten out into substantially horizontal rearward portion 30*c* having disposed preferably centrally thereon an inspection door 32 connected as, for example, by hinge 34 and made openable by operation of a handle 36. A conventional catch may be added as desired and door 32 may be useful as well if located elsewhere on housing 18. Rearward top wall portion 30*c* extends further rearwardly beyond door 32 until intersecting and continuing into an upper extent of back wall 24.

Although it is preferable that housing 18 be formed entirely of hardened steel, as described, it is conceivable that at least portions thereof may be formed of other materials to allow apparatus 10 to be lighter. Regardless of the materials used, whether of steel or otherwise, it is preferred that all seams and connections between the described walls be completely sealed, whether by welding or otherwise, so as to improve functioning of any vacuum applied to apparatus 10 and to decrease the dust leakage therefrom. It is further to be understood that the preferred dimensions of apparatus 10 are such that it is capable of sweeping the entire width of a single standard traffic lane of a road in one pass thereover. However, it is conceivable that apparatus 10 could be made wider so as to cover a greater surface area, or narrower, for example, for use in cleaning narrow walk ways, alleys and the like.

Centered on rearward portion 30*c* of top wall 30 is a debris outlet 38 which consists of a circular opening defined by an upward rising circular wall 39 terminating in an outward extending annular flange 40 for connection to debris conduit D by usual means.

Figures 3, 5:
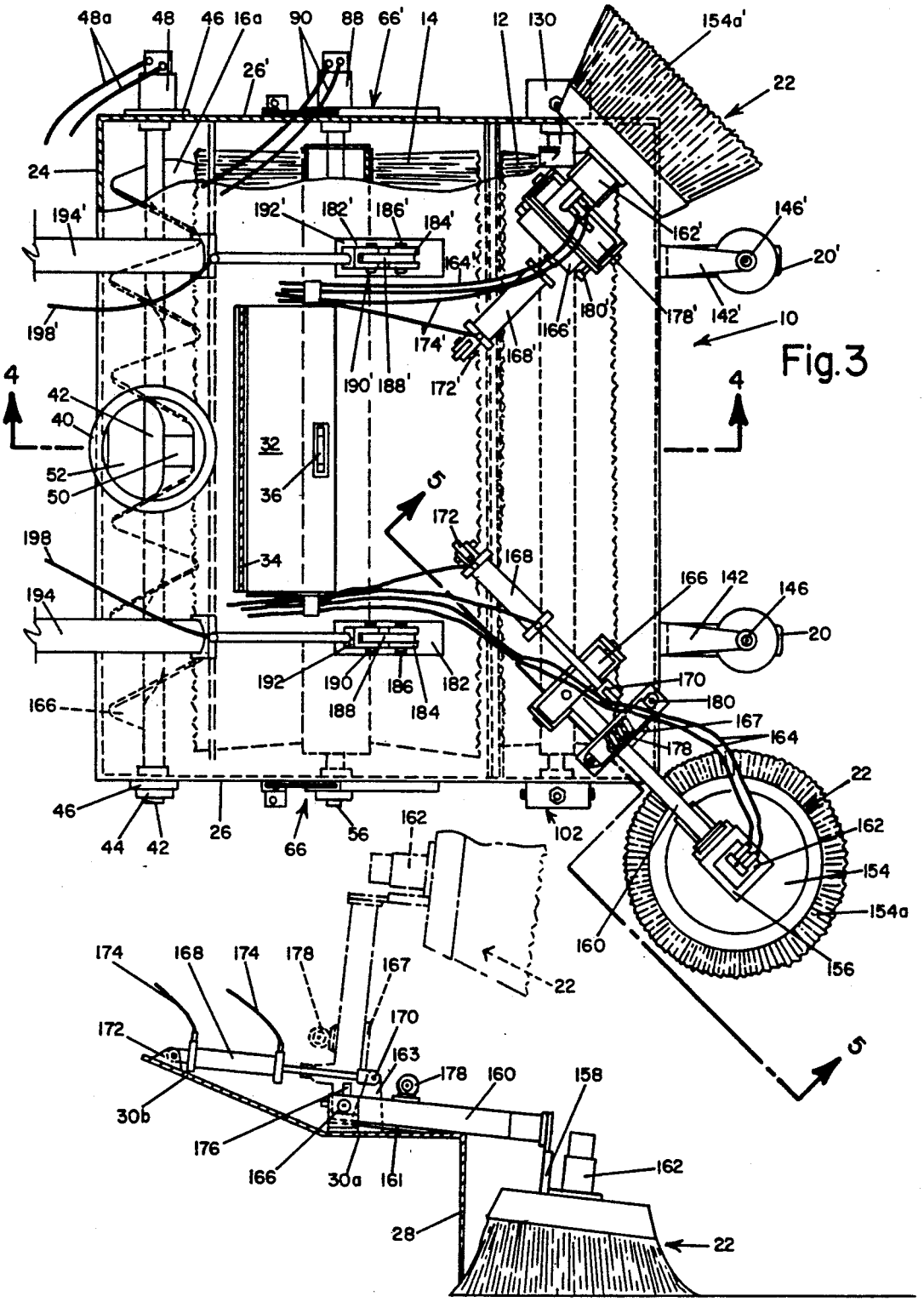
FIG. 3 is a top plan view of the sweeper of FIG. 1 schematically illustrating hydraulic lines attached thereto and partially broken away for viewing the internal attachment and arrangement of the roller brushes and auger.
FIG. 5 is a partial sectional view of the sweeper of FIG. 1 taken on line 5—5 of FIG. 3.

FIG. 3 illustrates that directly beneath debris outlet 38 is a debris feed conveyor 16 of the rotary screw or auger type including a shaft 42 extending transversely of housing 18 within the rearward upper portion thereof. Shaft 42 projects at opposing ends thereof through housing 18 side walls 26, 26' for journaling for rotation within bearings 44, 44' suitably mounted upon said side walls 26, 26' as by pillow blocks 46, 46' Shaft 42 extends beyond pillow block 46' for carrying a preferably hydraulic motor 48 connected by hydraulic lines 48a to hydraulic control unit P for selective operation of auger 16. Auger 16 further consists of paired cooperating screw conveyor blades 16a, 16b carried on shaft 42, the convolutions of blades 16a, 16b being arranged so that each will move contacted debris material inwardly toward a central portion of the conveyor. It is to be observed that each of the auger conveyor blades 16a, 16b at inner ends thereof terminate so as to define a central spacing 50 therebetween. Central spacing 50 is located directly beneath debris outlet 38 for passage of collected debris therethrough in the direction of hopper H. Should a particularly large piece of debris become jammed in auger 16, the operator of apparatus 10 can selectively rotate auger 16 forward and back (as indicated by arrow A, FIG. 4) in order to loosen the lodged item. If necessary, the operator can cut off all power to apparatus 10, dismount from cab C to inspect the blockage via door 32.

A curvate transversely mounted trough 52 is mounted coextensively beneath and parallel to auger 16 for retention of debris thereunder. Trough 52 is preferably constructed of one quarter inch hardened steel and is fixedly connected, for example, as by welding, to back wall 24 and side walls 26, 26'. Depending from trough 52 and coextensive therewith is inner wall 53 terminating approximately six inches from the pavement and to which is coextensively connected a narrow skirt 55.

At lower extremities of back wall 24, side walls 26, 26' and front wall 28 there is attached a narrow skirt 54. Skirts 54, 55 are preferably formed of rubber or other durable yet flexible, sheet-like material and are preferably attached to their respective walls as by screws or other known connectors (not shown) for occasional replacement thereof as necessary. Skirts 54, 55 function to enhance the effectiveness of a vacuum applied to apparatus 10, and to reduce dust and assist in retention of debris beneath housing 18 until collected and passed therethrough.

Figure 8:
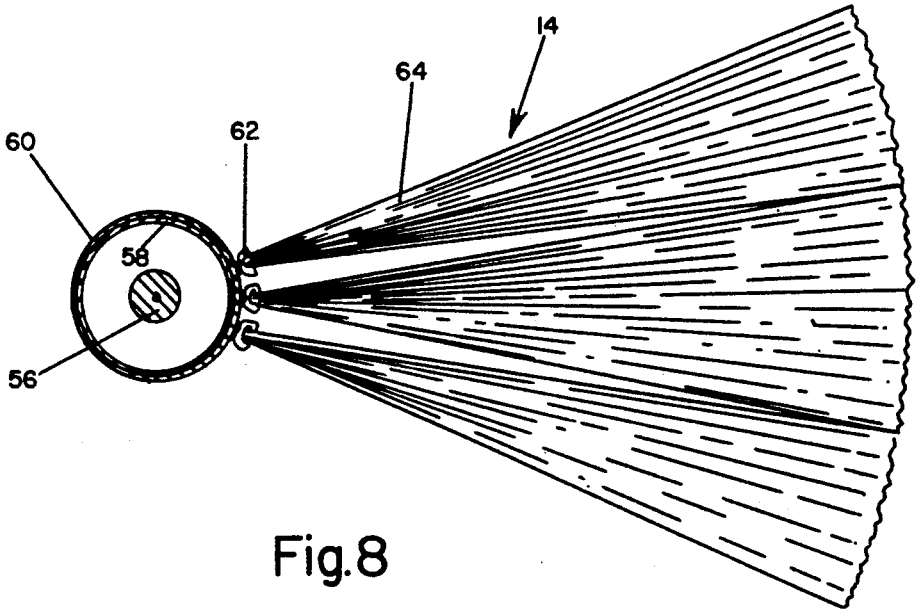
FIG. 8 is a partial enlarged end view of a portion of a transversely mounted roller broom of the sweeper of FIG. 1. to illustrate attachment of bristles thereon.

Downward and forwardly of axle 42 is rotatably mounted parallel thereto and transversely within housing 18 an axle 56 for carriage of rearward roller brush (or broom) 14. FIG. 8 illustrates in close-up the preferred construction of roller broom 14 wherein pipe 58 serves as a compression lock core for broom sleeve 60 which has mounted longitudinally thereon parallel longitudinal tracks 62 for carrying strips of preselected length of bristles 64. Such roller brooms and strips of bristles are commercially available, for example, from Milwaukee Dustless Brush Co. in Milwaukee, Wis. Bristles 64 of roller brush 14 preferably consist of very tough elongated metal wires which may be coated, as with a plastic material, for longevity. Bristles 64 are stiff enough to propel heavy debris of two pounds or more and up to eight inches in diameter through housing 18, yet are capable of flexing to avoid breakage should a particularly securely embedded or heavy object be encountered. Conceivably, other roller broom constructions may function adequately.

Figure 2:
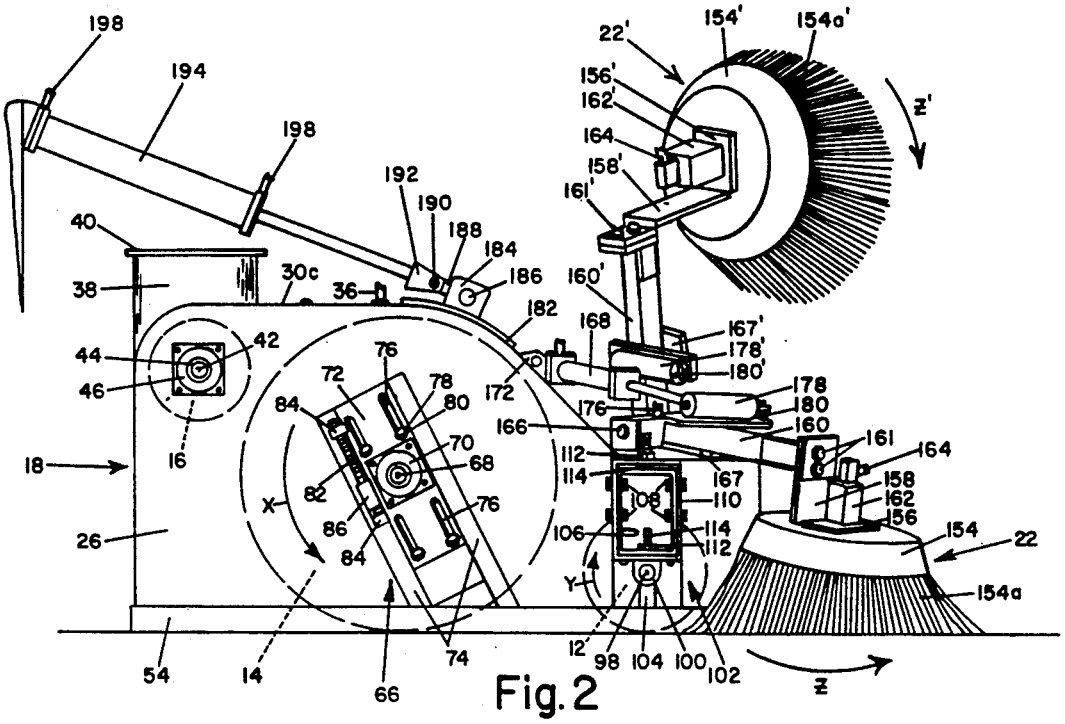
FIG. 2 is a right side elevation view of the sweeper of FIG. 1. illustrating the location of the brooms and auger therein, in phantom.

FIGS. 2 and 3 illustrate mechanisms 66, 66' for mounting and adjustment of roller brush 14 on corresponding right and left side walls 26, 26' of housing 18. As mechanisms 66, 66' are identical, like parts carry like numbers for simplicity of discussion immediately hereafter.

Axle 56 is rotatably mounted by bearings 68 within pillow blocks 70 at each end thereof, which pillow blocks 70 are mounted exteriorly of side walls 26, 26' on identical adjustment plates 72. Adjustment plates 72 lie flush, on each against their corresponding side walls, 26, 26', and are rectangular in nature, each opposing long side thereof being slidably held under parallel, paired rigid metal slides 74 mounted at an angle of preferably 26° rearwardly on walls 26, 26' for forwardly, downward diagonal adjustment of plates 72, and thereby roller broom 14, as required when bristles 64 become shorter with wear caused by use. Adjustment plates 72 are each provided with a plurality of longitudinal guide grooves 76 for reception of bolts 78 each provided with a tightening nut 80 thereon. A threaded rod 82 is connected at one end thereof to adjustment plate 72 and at an opposed end to a slide 74 as by brackets 84, 84', respectively, and plate 72 (and so roller brush 14) is made precisely, selectively adjustable by threaded disposition of adjustment nut 86 above bracket 84' on rod 82.

FIG. 3 illustrates that on the left end of axle 56 is mounted a hydraulic motor 88 connected as by hydraulic lines 90 (schematically shown) to hydraulic control unit P for selectively causing rotation of roller broom 14 in a counterclockwise direction (as viewed from the right end thereof), as indicated by arrow X in FIG. 2 so as to cause debris lifted thereby to be moved upwardly and rearwardly toward auger conveyor 16.

Figure 4:
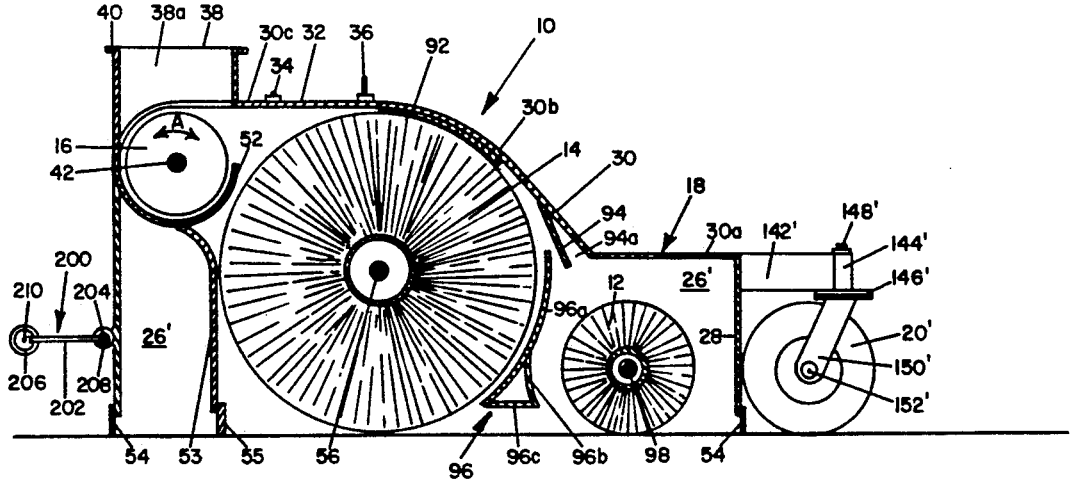
FIG. 4 is a sectional view of the sweeper of FIG. 1 taken on line 4—4 of FIG. 3.

Illustrated in FIG. 4 is a reinforcing plate-like rectangular shield 92 fixed transversely to the inside of curved portion 30b of housing top wall 30 so as to provide protection from wear from the scraping action of bristles 64 of roller broom 14 and debris moved through apparatus 10 thereby. Shield 92 is preferably formed of ¼ inch hardened steel for durability.

Forwardly and downward, in relation to reinforcing shield 92 is a deflection shield 94 fixed as by welding transversely at a slight angle downward and backward toward roller broom 14 on the inside of top wall portion 30b, immediately before the juncture therewith of flat horizontal portion 30a. Deflection shield 94 forms with top wall portion 30b a space 94a which is triangular in cross-section, which space 94a traps debris too large to pass under shield 94.

Directly beneath deflection shield 94 transversely within housing 18 and fixed at side walls 26, 26' thereof, is an integral "berm builder" 96 having an extended portion 96a which curves rearwardly upward in corresponding fashion to the curvature of roller broom 14, but terminates spacedly beneath shield 94, and a lower portion 96b which curves forwardly so as to be concave in relationship to forward roller broom 12. Rearwardly curved portion 96a and forwardly curved portion 96b are connected at their lower extremes by a horizontal flat plate 96c so that in cross section the three portions, 96a, 96b, 96c, form a modified triangle, with rearwardly curved portion 96a continuing to extend upwardly rearward therefrom.

In downward forward parallel relationship to axle 56 is mounted an axle 98 for transverse mounting within housing 18 of forward roller broom 12. It is preferred that forward roller broom 12 be substantially smaller in diameter than rearward roller broom 14, although otherwise constructed identically, such construction permitting housing 18 to be smaller, lighter and less expensive. It is especially preferred that the overall diameter of broom 14 be 36 inches and that of forward roller broom be 14 inches. However, if housing 18 is made large enough, a larger forward roller broom, even of equal dimension as broom 14 could adequately be used.

Referring to FIG. 2, the right end of axle 98 penetrates side wall 26 of housing 18 where it is suitably mounted in a pillow block 100 connected to a support and adjustment mechanism 102 to permit selective adjustable movement of the right end of axle 98 in a vertical slot 104 formed in the forward portion of wall 26. Support and adjustment mechanism 102 consists of an open-faced rectangular metal box 106 having a pillow block 100 attached at a lower end thereof, and is adjustably connected as by side mounted nut and bolt assemblies 108 to the interior of a rectangular frame 110 fixed forwardly on side wall 26. Box 106 and therefore pillow block 100 and connected axle 98 are vertically adjustable by positive screw adjustment consisting of manipulation of nuts 112 provided on threaded rods 114 in order to gradually forwardly move the right end of roller brush 12 vertically downward as the bristles thereof become shorter through wear.

Figure 7:
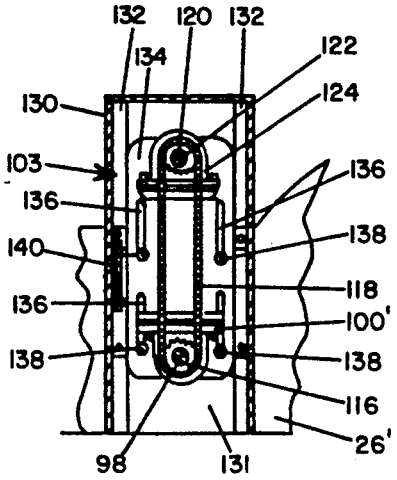
FIG. 7 is sectional view taken on line 7—7 of FIG. 6.

FIG. 7 illustrates a support and adjustment mechanism 103 mounted forwardly on housing side wall 26' and into which the left end of axle 98 is journaled as by sprocket 116. Sprocket 116 connects by drive chain 118 to sprocket 120 which in turn journals drive shaft 122 which latter travels inwardly through pillow block 124 and through back wall 131 of cabinet 130 to connect to hydraulic motor 126 which is in turn connected as by hydraulic lines 128 to hydraulic control unit P for selectively causing rotation of forward roller broom 12 in a clockwise direction as viewed from the right end thereof, as illustrated by arrow Y in FIG. 2. Pillow blocks 100', 124 are each mounted on adjustment plate 134 so as to be adjustable, as by bolt and nut attachment, to permit loosening or tightening of drive chain 118, as necessary. So constructed, drive shaft 122 and forward broom 12 shaft (axle) 98 are both fixed to adjustment plate 134 so as to move in constant relationship to each other, as hereafter described.

Because of the inherent accident risk of the abovedescribed drive chain assembly therein, support and adjustment mechanism 103 on left side wall 26' is entirely enclosed for safety within an openable rigid metal cabinet 130.

Mechanism 103 is similar in internal construction and operation to mounting and adjustment mechanism 66, 66'. Thus, mechanism 103 also has parallel rigid slides 132 for sliding reception of adjustment plate 134. Preferably four longitudinal guide grooves 136 are also provided in adjustment plate 134 for receipt of and tightening by adjustment nut and bolt assemblies 138. A threaded rod and adjustment nut assembly 140, similar to that previously described in regard to support and adjustment mechanism 66, is attached to one slide 132 and adjustment plate 134. With mechanism 103 so constructed, hydraulic motor 126 is vertically adjustable in concert with the left end of axle 98, which later of course is to be adjusted preferably equally and simultaneously with the right end of axle 98 for even lowering of forward roller 12 as the bristles thereof become worn.

Figure 6:
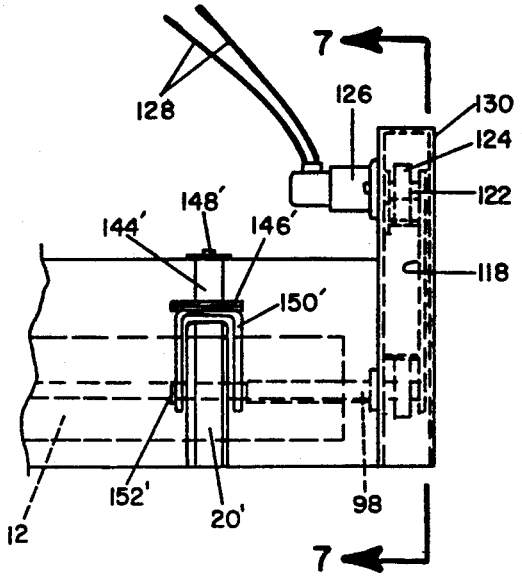
FIG. 6 is a partial cutaway front elevation view of the left front end of the sweeper of FIG. 1, illustrating the front roller broom and drive mechanism therefor in phantom.

FIGS. 3 and 6 show that inward from side walls 26, 26' are preferably a pair of spaced apart freely pivotal support wheels 20, 20', respectively. Support wheels 20, 20' are each fixed to front wall 28 of housing 18 by a corresponding rigid support bar, 142, 142' having vertically fixed at outward ends thereof rigid sleeves 144, 144' with circular flanges 146, 146' at the lower ends thereof. Rigid sleeves 144, 144' are penetrated by vertical shafts 148, 148' having U-clamps 150, 150' fixed at lower ends thereof in inverted position for flanking wheels 120, 120'. The extreme ends of U-clamps 150, 150' and wheels 20, 20' are penetrated by axles 152, 152', respectively. So mounted, wheels 20, 20' rotate freely on axles 152, 152' and pivot freely on shafts 148, 148' within sleeves 144, 144' as necessary for propulsion of apparatus 10 by a prime mover such as truck T. In this preferred embodiment, wheels 20 each have a diameter of approximately 15 inches. However, other wheel sizes will suffice.

FIGS. 2, 3 and 5 illustrate rotatable disk-shaped brush assemblies 22, 22' (also referred to as gutter brooms or curb brooms) adjustably mounted on top wall 30 of housing 18 so as to angle outwardly substantially over the intersections of side walls 26, 26' with the corresponding right and left ends of front wall 28.

Curb broom assemblies 22, 22' are mirror images of each other, curb broom assembly 22 being mounted toward the right side of housing 18 and assembly 22' being mounted toward the left side of housing 18. Broom assemblies 22, 22' include conventional circular or disk-shaped broom heads 154, 154' having elongated bristles **154*a*, 154*a'* extending therefrom and which are available commercially. Disk-shaped broom heads 154, 154' are mounted as by rigid plates 156, 156' to flanges 158, 158', respectively, which (in operational mode) depend perpendicularly from arms 160, 160' to which they are connected as by bolts 161, 161'. Arrows Z, Z' in FIG. 2 indicate the respective direction of rotation of broom heads 154, 154' when curb broom assemblies 22, 22' are in operational mode. Such rotation is effected by hydraulic motors 162, 162' mounted respectively on plates 156, 156' above their corresponding broom head and connected as by hydraulic lines 164, 164'** (shown schematically), in turn connected by usual means to hydraulic control unit P.

Support arms 160, 160' each terminate inwardly where they connect as by bracket and bolt assemblies 166, 166' at outer ends of rectangular plates 167, 167' so as to be vertically pivotal thereon; which plates 167, 167' are in turn connected at outer ends thereof as by conventional clevis and pin arrangements 170, 170' to hydraulic cylinders 168, 168'. (Clevis and pin arrangement 170' is hidden from view). Curb broom assembly 22' is shown in a raised, non-operating position so as to hide bracket and bolt assembly 166' from view. Such position is useful when it is desired only to sweep along a right hand curb as the prime mover travels in the normal direction of traffic. Vertical raising and lowering of curb broom assemblies 22, 22' is accomplished by operation of hydraulic cylinders 168, 168' connected to upper wall portion **30*b* of housing 18 at inner ends thereof by clevis and pin arrangements 172, 172'. Operation of hydraulic cylinders 168, 168' is accomplished as by connection of hydraulic lines 174, 174' to hydraulic control unit P. Curb broom assemblies 22, 22' pivot slightly horizontally about pivot pins 176, 176' which penetrate the inwardly directed ends of support arms 160, 160' (horizontal pivot pin 176' is hidden from view) A limited degree of horizontal "give" is provided to support arms 160, 160' by connection thereto of enclosed, normally outwardly biased coil springs 178, 178'** mounted as by plate and bolt assemblies 180, 180' therebeneath to the inwardly directed end of support arms 160, 160'. Enclosed coil spring 178 is shown partly broken away in FIG. 3. The provision of enclosed coil springs 180, 180' permits each curb broom assembly 22, 22' to bounce inwardly away from the respective curb being swept should a particularly rigid object be encountered. This bounce allowance prevents breakage of support arms 160, 160'.

Welded spacedly apart of curved top wall portion **30*b* of housing 18 are curved rectangular connection plates 182, 182' each having fixed thereto upwardly extending paired flanges 184, 184' horizontally penetrated therethrough by bolt 186, 186'. Bolts 186, 186' each penetrate outer ends of connector plates 188, 188' which in turn are connected at opposing ends thereof by clevis pins 190, 190' for connection to clevises 192, 192', respectively, to thereby attach large hydraulic cylinders 194, 194' to housing 18. Hydraulic cylinders 194, 194' are further connected at their inward directed ends to cab C of truck T by further clevis and pin arrangements such as at 196' shown in FIG. 1. Hydraulic lines 198, 198' connect hydraulic cylinders to control unit P for operation of hydraulic cylinders 194, 194' to permit lifting or lowering of sweeper 10** for transport along a roadway in the raised position or operation in the sweeping mode in a lowered position.

It is to be understood that all power or control mechanisms referred to in this application as "hydraulic" can satisfactorily be replaced with pneumatic or other known power systems.

To assist in lifting and propulsion of apparatus 10 by truck T, a lift hinge assembly 200 is provided and consists of a rigid metal strip 202 which is transversely coextensive with back wall 24 and is adapted along each longitudinal edge thereof with fixed metal rings (not shown) which rings are fixed on one longitudinal edge of strip 202 and aligned for use with rigid metal rings 204 corresponding in size and fixed toward the base of back wall 24 of housing 18, and which rings on an opposing longitudinal side of strip 202 are aligned with rigid rings 206 which are fixed to a front portion of prime mover T, such as to a bumper or, if necessary, to a control unit P as shown in FIG. 1. With the described unshown rings of strip 202 aligned with corresponding rings 204, 206 steel bars 208, 210 are removably disposed transversely through the rings, so that lift assembly 200 acts in a hinge-like manner with some amount of vertical "play" as apparatus 10 is propelled forwardly or adjusted vertically up and down by control unit P on prime mover T.

Accordingly, rather than relying only on air flow to move debris from the ground into the hopper, as in conventional vacuum-type sweepers, the present invention facilitates the movement of debris closer to the source of the air flow by carrying such debris with brooms; i.e., forward mounted rotatable disk-shaped broom assemblies 22, 22' contact debris and throw it inwardly toward the front of apparatus 10, which passes over such debris, and collects it by rotational sweeping movement of front roller broom 12. Thereafter by action of broom 12 and the applied vacuum, collected debris is forced upward and rearwardly toward large roller broom 14. Small debris will pass between deflection shield 94 and berm builder 96 just under section **30*b* of top wall 30 of housing 18. Larger debris which will not pass through the space beneath deflection shield 94 will fall and be forced by roller broom 12 beneath horizontal portion 96*c* of berm builder 96 so as to be passed thereunder into the path of roller broom 14 which will then sweep it upwardly forward by flexible bristles 64, around and into auger 16. The action of auger blade 16*a*, 16*b* will necessarily cut and crush some larger debris so that it can pass through debris outlet 38**.

It is clearly seen that the new pavement sweeper 10 has a wide variety of uses, particularly in commercial areas, such as use by cities for street sweeping, in mines which create a great deal of dust, such as soda ash mines, and in power plants, for example, or other areas where cleaning without use of water is required. A particularly illustrative successful use of the new pavement sweeper is in coal mines where coal has been swept up and accumulated in hopper H at a rate of one ton per minute.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An apparatus for sweeping of debris from pavement surfaces; said apparatus comprising:

a) a rigid housing;

b) a first roller broom and a second roller broom and means for rotatably mounting said first roller broom and said second roller broom transversely within said housing spacedly and parallel in relation to each other, said first roller broom being disposed forwardly of said second roller broom, each of said roller brooms being elongated and having right and left ends relative to a position of an operator of said apparatus and extending between the operator right and operator left ends;

c) means for causing said first roller broom to rotate clockwise, as viewed from the operator right end thereof, and means for causing said second roller broom to rotate counterclockwise as viewed from the operator right end thereof;

d) debris outlet means connected to a vacuum source for removal of debris from inside of said housing to the exterior thereof;

e) means for focusing movement of debris within said housing toward said debris outlet means, said means for focusing movement of debris being disposed within said housing substantially beneath said debris outlet means;

f) a plurality of support wheels rotatably attached to said housing; and g) means for connecting said apparatus to a prime mover to thereby permit propulsion of said apparatus along the surface being swept and transport of said apparatus when non-operational.

2. The apparatus of claim 1, and further comprising a berm builder for building up a berm of debris within said housing rearwardly of said first roller broom and substantially parallel thereto, said berm builder being disposed transversely within said housing and connected thereto between said first roller broom and said second roller broom.

3. The apparatus of claim 1, wherein said first roller broom is substantially smaller in diameter than said second roller broom.

4. The apparatus of claim 1, wherein said first roller broom and said second roller broom are comprised of fine, elongated bristles which are stiff but capable of being flexed.

5. The apparatus of claim 4, wherein said bristles are premounted on replaceable strips of preselected length for replacement as necessary due to wear and subsequent shortening of said bristles.

6. The apparatus of claim 1, wherein said first roller broom and said second roller broom are adjustable independently of each other in a substantially vertical direction to thereby permit lowering of said first roller broom and said second roller broom toward the surface being swept as bristles of said brooms become shorter through wear.

7. The apparatus of claim 1, wherein the rigid housing comprises a top wall, a front wall, a rear wall, and left and right side walls forming an open-bottomed enclosure defining an interior thereof having a forward portion and an upper rearward portion, and the left and right side walls being substantially parallel to each other.

8. The apparatus of claim 7, wherein the rigid housing is provided on the interior thereof with a rigid debris deflection plate transversely fixed to the top wall of said housing forwardly and adjacent in relation to said second roller broom so as to be longitudinally substantially coextensive therewith and to angle downwardly toward said second roller broom and away from the top wall of said housing.

9. The apparatus of claim 7, wherein said housing further comprises an elongated metal plate fixed transversely to an interior surface of the top of said housing above at least a portion of said second roller broom to shield against wear of the interior surface caused by contact with a portion of said second roller broom.

10. The apparatus of claim 7, wherein the debris outlet means comprises a hollow shaft opening to the exterior of said housing at the upper rearward portion thereof and said means for focusing movement of debris within said housing toward said debris outlet means comprises a feed conveyor of the auger type rotatably disposed transversely in the upper rearward portion of said housing rearward of and adjacent to said second roller broom, coextensively therewith; and said apparatus further comprising a curved trough fixed transversely within said housing directly beneath and coextensive with said feed conveyor, said feed conveyor having convolutions arranged for directing received debris toward an intervening spacing located centrally on said feed conveyor and directly beneath said debris outlet means.

11. The apparatus of claim 7, wherein the plurality of support wheels comprises two support wheels rotatably attached forwardly of said housing to the front wall of said housing spacedly in relation to each other and inward by a substantially equal distance from corresponding right and left side walls of said housing.

12. The apparatus of claim 1, wherein said housing comprises a door for inspection of at least a portion of the interior of said apparatus.

13. The apparatus of claim 1, wherein said means for causing said first roller broom to rotate clockwise and said means for causing said second roller broom to rotate counter clockwise are each hydraulic motors.

14. The apparatus of claim 1, wherein said means for connecting said apparatus to a prime mover is constructed so as to be of sufficient strength to permit lifting said apparatus at least in part from the surface to be swept to thereby facilitate transport of said apparatus.

15. The apparatus of claim 1, and further comprising at least one rotatable disk-shaped broom mounted exteriorly on said housing to thereby permit simultaneous sweeping of at least one path adjacent to a surface directly in front of said apparatus during operation thereof.

16. The apparatus of claim 15, wherein said apparatus further comprises means for selective vertical adjustment of said at least one rotatable disk-shaped broom to permit selective use thereof, and means for horizontal pivotal movement of said at least one rotatable disk-shaped broom.

17. The apparatus of claim 16, wherein said means for selective vertical adjustment of said rotatable disk-shaped broom comprises a hydraulic mechanism.

18. The apparatus of claim 16, wherein said means for horizontal pivotal movement comprises a coil spring and a rigid arm carrying said coil spring, the rigid arm having said disk-shaped broom rotatably mounted at an outer end thereof.

19. The apparatus of claim 15, wherein there are two rotatable disk-shaped brooms, one of said rotatably disk-shaped brooms mounted on each of two front corners of said housing to permit simultaneous use thereof for sweeping an area on each side of a set of railroad tracks during simultaneous sweeping of said tracks by said roller brooms of said apparatus.

20. In combination with an independent, mobile debris receptacle, a vacuum provided in said receptacle for drawing debris thereinto, of an apparatus for sweeping debris from pavement surfaces; said apparatus comprising:

a) a rigid housing;

b) a first roller broom and a second roller broom and means for rotatably mounting said first roller broom and said second roller broom transversely within said housing spacedly and parallel in relation to each other, said first roller broom being disposed forwardly of said second roller broom, each of said roller brooms being elongated and having right and left ends and extending between the operator right and operator left ends;

c) means for causing said first roller broom to rotate clockwise, as viewed from the operator right end thereof, and means for causing said second roller broom to rotate counterclockwise as viewed from the operator right end thereof;

d) debris outlet means for removal of debris from inside of said housing to the exterior thereof;

e) means for focusing movement of debris within said housing toward said debris outlet means, said means for focusing movement of debris being disposed within said housing substantially beneath said debris outlet means;

f) a plurality of support wheels rotatably attached to said housing; and g) means for connecting said apparatus to a prime mover to thereby permit propulsion of said apparatus along the surface to be swept and for transport of said apparatus.

* * * * *